US006358106B1

(12) United States Patent
Herrera

(10) Patent No.: US 6,358,106 B1
(45) Date of Patent: Mar. 19, 2002

(54) VIBRO-ACOUSTIC TREATMENT FOR ENGINE NOISE SUPPRESSION

(75) Inventor: Eric Herrera, Burlington, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/570,629

(22) Filed: May 15, 2000

(51) Int. Cl.[7] ..... B63H 20/32
(52) U.S. Cl. ..... 440/77; 181/204
(58) Field of Search ..... 440/76, 77; 181/204, 181/294

(56) References Cited

U.S. PATENT DOCUMENTS

| | | | | | |
|---|---|---|---|---|---|
| 3,845,839 | A | * | 11/1974 | Eriksson | 440/52 |
| 3,955,526 | A | * | 5/1976 | Kusche | 440/77 |
| 4,278,852 | A | * | 7/1981 | Gorike | 381/372 |
| 4,463,049 | A | * | 7/1984 | Kracke | 442/120 |
| 4,488,619 | A | * | 12/1984 | O'Neill | 181/290 |
| 5,298,694 | A | * | 3/1994 | Thompson et al. | 181/286 |
| 5,635,562 | A | * | 6/1997 | Malcolm | 525/108 |
| 6,032,769 | A | * | 3/2000 | Daudi | 188/218 R |
| 6,056,611 | A | | 5/2000 | House et al. | |

OTHER PUBLICATIONS

Polymer Technologies Inc. Product Data Sheets for Polydamp™ Acoustical Foam (1990), Polydamp™ Acoustical Barriers (1990) and Polydamp™ Extension Dampung Pad (1989).

* cited by examiner

*Primary Examiner*—S. Joseph Morano
*Assistant Examiner*—Andrew D. Wright
(74) *Attorney, Agent, or Firm*—Dennis M. Flaherty

(57) ABSTRACT

The vibro-acoustic energy produced by an engine is reduced by shrouding the powerhead with a blanket of material that both damps vibrations and absorbs acoustic wave energy. This vibro-acoustic treatment is applied on the inner surface or surfaces of a motor housing of a propulsion system. The housing is treated by adhering a sheet of acoustic barrier material to the housing inner surface. The acoustic barrier material is designed to block transmission therethrough of a substantial portion of impinging acoustic wave energy in a range from at least 1,000 to 3,000 hertz. The layer of adhesive material has a thickness such that impinging acoustic wave energy in a range of 1,000 to 3,000 hertz is efficiently converted into heat energy. An open-cell foam core laminated to the sheet of acoustic barrier material absorbs the trapped, blocked, acoustic wave energy. The open-cell foam core has an average pore size that is optimized to absorb acoustic wave energy in a range of 1,000 to 3,000 hertz.

30 Claims, 6 Drawing Sheets

VIBRO-ACOUSTIC TREATMENT FOR ENGINE NOISE SUPPRESSION

FIELD OF THE INVENTION

This invention relates to a structure for providing internal combustion engine noise suppression.

BACKGROUND OF THE INVENTION

Typical marine engines are noisy, especially when being operated at higher rpm's while driving a vessel rapidly through the water. This noisy operation is extremely unattractive to occupants of the vessel, as well as to passers-by, and it is highly desirable to reduce this noise without reducing vessel efficiency. Further, regulatory bodies, in their desire to improve the environment, are imposing emission standards on marine vessels. These standards not only regulate the contents of the emissions but also apply to the noise level of the emission. It is therefore highly desirable to provide a marine engine that is noise reduction efficient without detracting from the vessel operating efficiently.

More general than the noise reduction is noise control. Noise control requires an understanding of the vibro-acoustic behavior of the article in question with its environment. If boundary conditions permit, approximations can be made by isolating the article from its environment. This cannot be done "simply" for an integrated structure. For example, an outboard marine engine is an integrated structure. To capture correctly the vibro-acoustic behavior of an outboard engine, the engine should be fully assembled, mounted to a boat and in the open water. For example, feedback from the added inertia of the water as the boat travels in the water could produce a narrow-band spectrum different from a steady-state condition. There is also feedback from the components of the engine, for example, the crankshaft and block can produce a phenomenon that does not exist for either part acting alone.

To determine the acoustic "fingerprint" for an integrated structure such as an outboard marine engine, a narrow-band analysis must be performed. This will allow identification of tones, i.e., frequency responses, of the interacting components. The components corresponding to these responses can be identified from the frequencies, i.e., based on wavelength and speed of sound. Vibro-acoustic treatments can be designed and or critically placed to attenuate or simply move a tone from one frequency to another. The effectiveness of this effort is based on the precision of the data and the methodology by which the data is acquired.

The precision of the data is a function of the frequencies of the data collected and of the transducer sensitivity. The frequency range of interest is a function of human hearing, i.e., 10 kHz is sufficient. For the present work, data was collected using accelerometers and microphones. Accelerometer data was collected to 5 kHz at 1 Hz bandwidth; microphone data was collected to 10 kHz at 2.5 Hz bandwidth. Acoustic intensity testing and stethoscopic probing both showed agreement that over 80% of the vibro-acoustic energy produced by a particular outboard marine engine was coming from below the interface between the engine's upper and lower motor covers.

Thus there is a need for a structure which can be incorporated inside an outboard marine engine to achieve noise suppression without adversely impacting engine performance.

SUMMARY OF THE INVENTION

The present invention is directed to an improved engine having means for controlling and reducing the noise emitted by the engine. Although the preferred embodiment is disclosed in the context of an outboard marine engine, persons skilled in the art will readily appreciate that the means for noise suppression could also be installed inside the housing for the powerhead of an inboard marine engine or any other type of powerhead encased in a housing. (The terms "powerhead" and "motor" will be used interchangeably throughout the written description and the claims.)

One approach for reducing the vibro-acoustic energy produced by an engine is to shroud the powerhead with a blanket of material that both damps vibrations and blocks/absorbs acoustic wave energy. Such material will be hereinafter referred to as a "vibro-acoustic treatment". The vibro-acoustic treatment in accordance with the preferred embodiments is applied on the inner surface or surfaces of a motor housing of a propulsion system.

In accordance with the preferred embodiment of the invention, the noise generated by an outboard marine engine can be controlled and reduced by installing vibro-acoustic treatments inside both the upper and lower motor covers, forming a shroud around the powerhead. Each treatment comprises an acoustic barrier laminated to an open-cell foam core that absorbs acoustic energy. The mass per unit area of the acoustic barrier for the lower motor cover is preferably greater than that of the acoustic barrier for the upper cover, while the foam layer for the lower motor cover is preferably thicker than the foam layer for the upper motor cover. These vibro-acoustic treatments are designed to work together. For example, the treated lower motor cover is designed to attenuate the overall acoustic energy and the treated upper motor cover is designed to shape the frequency spectrum, i.e., to act as a filter. This is analogous to a home stereo system, where the lower motor cover is the power amplifier and the upper motor cover is the equalization filter. The treated upper motor cover needs the treated lower motor cover in order to perform as it was designed to. The treated lower motor cover is independent of the treated upper motor cover, although the treated upper motor cover provides the refined sound enabling a superior sound quality. The treated lower motor cover provides the noise reduction, while the treated upper motor cover, in concert with the treated lower motor cover, provides the sound quality, i.e., the noise control.

More specifically, the primary purpose of the treatment in the upper motor cover is to tailor the narrow-band acoustic spectrum so that it is "pleasing" to the human ear. The human ear is most sensitive to frequencies between 1,000 and 3,000 hertz. In accordance with the preferred embodiment, the vibro-acoustic treatment inside the upper motor cover is designed to shift acoustic energy in the frequencies between 1000 and 3000 Hz to frequencies below 1000 Hz and above 3000 Hz. In contrast, the lower motor cover can be considered the primary receiver of the structure-borne noise and vibration. To best attenuate this energy, the vibro-acoustic treatment for the lower motor cover is designed to attenuate across a wide frequency range (e.g., 0 to 4,000 hertz), but was optimized for the frequencies under 1000 Hz. The vibro-acoustic treatment on the upper motor cover was not designed to attenuate frequencies below 1,000 hertz because to do so would require additional mass inside the upper motor cover, which additional mass would negatively impact overall engine performance, e.g., by interfering with the intake of air.

DETAILED DESCRIPTION OF THE PREFERRED EMBODIMENTS

Figure 1:
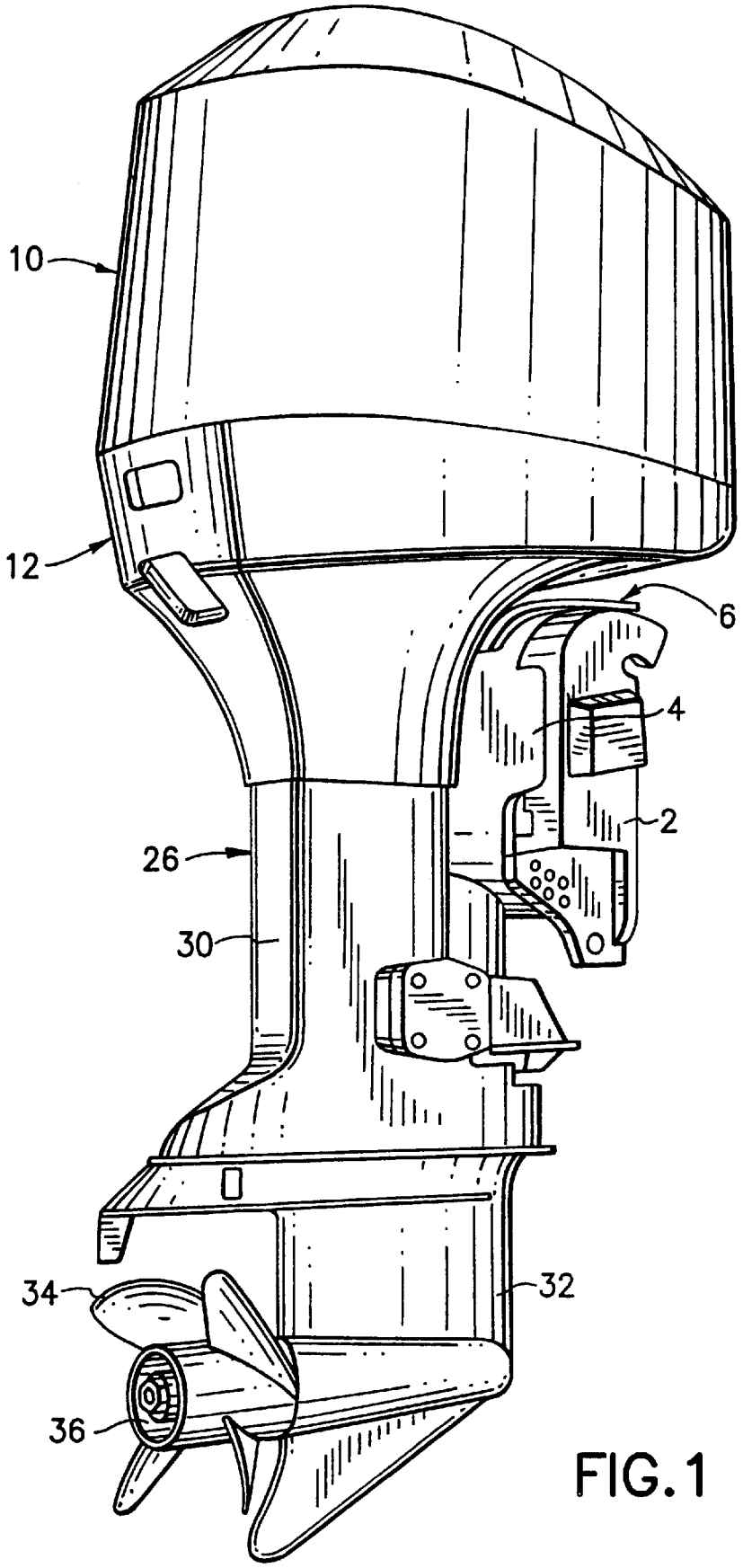
FIG. 1 is a schematic showing a typical outboard marine engine to which the present invention can be applied.

An outboard propulsion unit and means for mounting that propulsion unit to the stern of a boat are shown in FIG. 1. The mounting means comprise a pair of stern brackets 2 (only one of which is visible in FIG. 1) designed to be mounted to the boat stern. A swivel bracket 4, which supports the propulsion unit, is pivotably mounted to the stern brackets 2. The swivel bracket 4 allows the propulsion unit to be tilted about a horizontal axis. The swivel bracket 4 rotatably supports a steering arm assembly 6 (only part of which is visible in FIG. 1) which is rigidly connected to the propulsion unit, to allow the propulsion unit to be turned about the axis of the steering arm assembly 6 for steering the boat.

Figure 2:
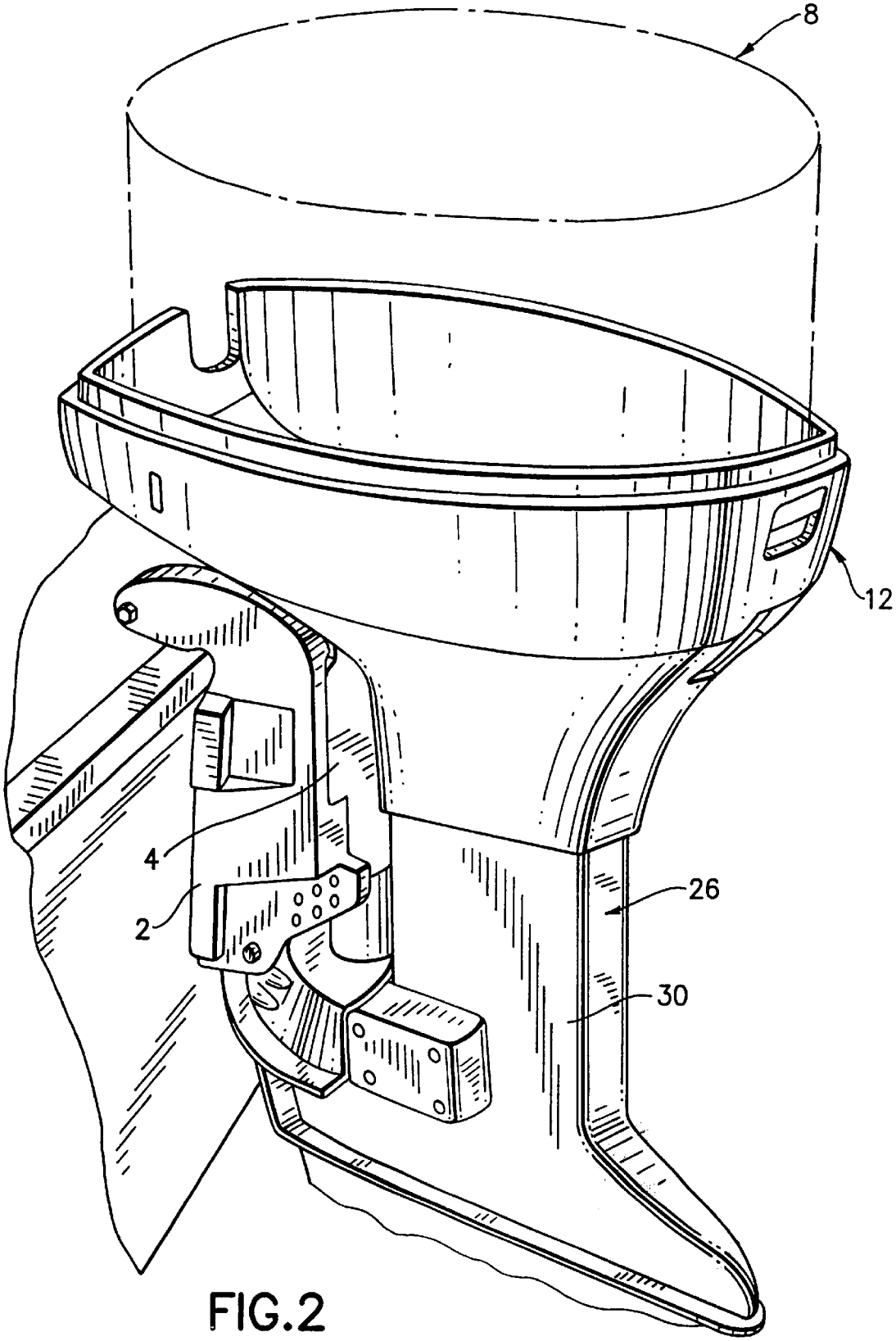
FIG. 2 is a schematic showing the outboard marine engine of FIG. 1 with the upper motor cover removed to reveal the powerhead.
Figure 3:
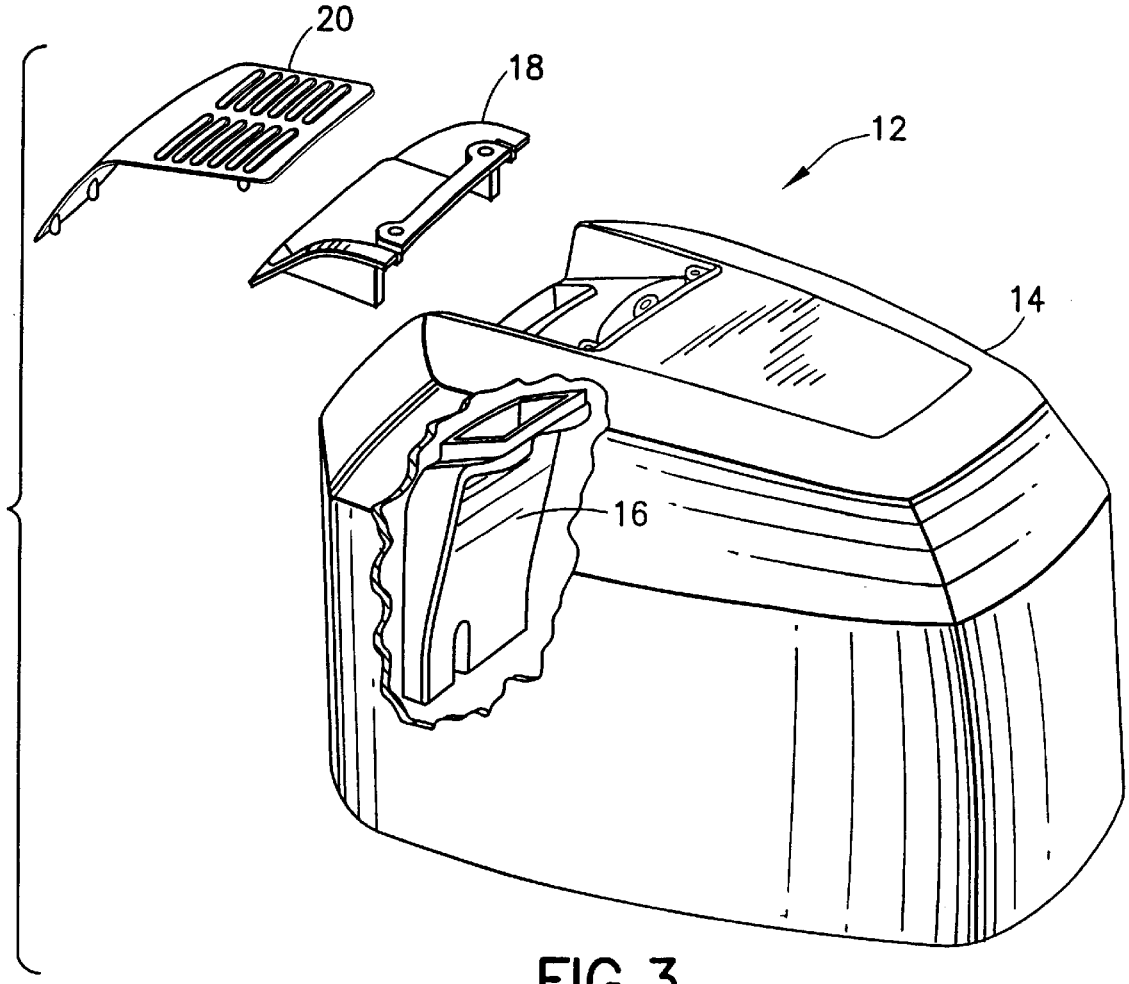
FIG. 3 is a schematic showing an upper motor cover for the outboard marine engine shown in FIG. 2.
Figure 4:
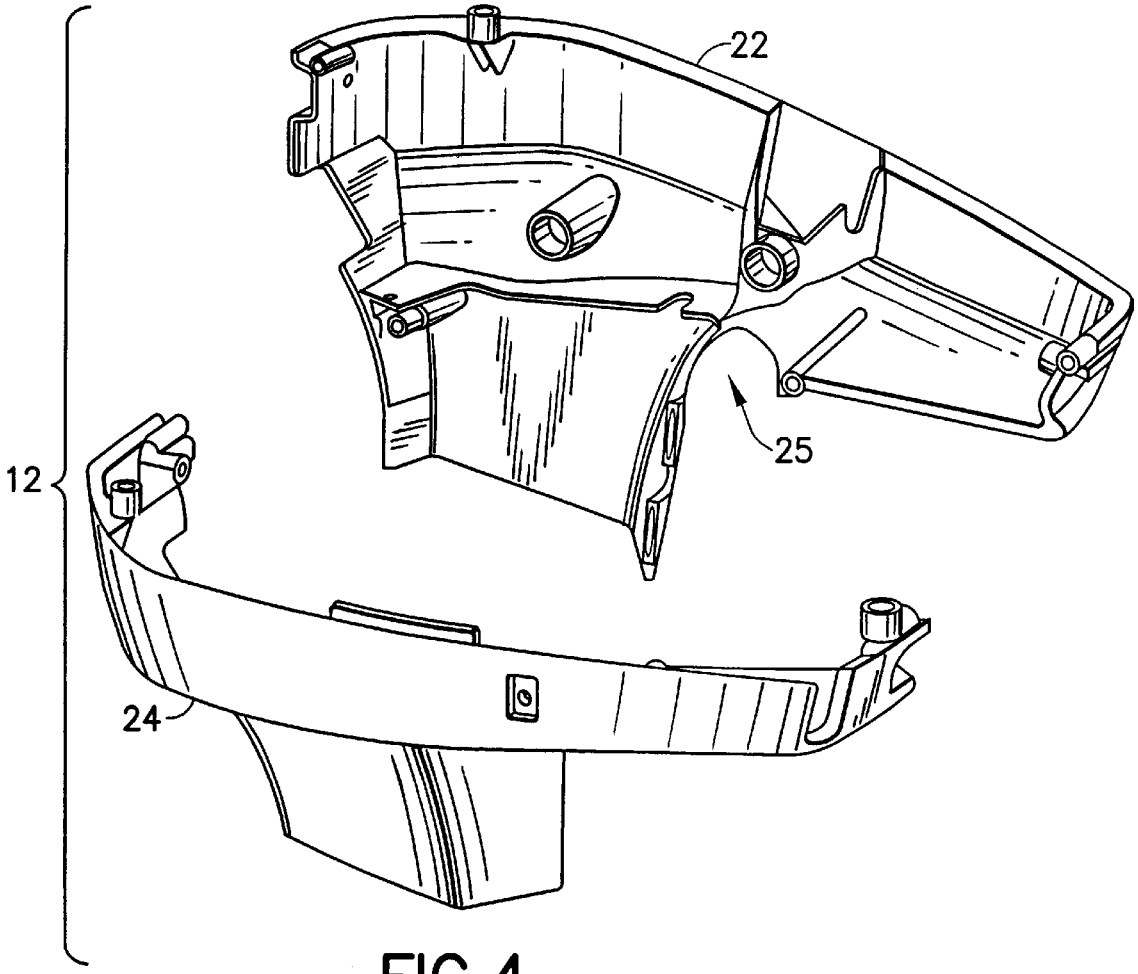
FIG. 4 is a schematic showing port and starboard lower covers for the outboard marine engine shown in FIG. 2.

The propulsion unit comprises a powerhead 8 (generally outlined in FIG. 2) housed in a casing formed by an upper motor cover assembly 10 and a lower motor cover assembly 12. As shown in FIG. 3, the upper motor cover assembly preferably comprises an upper motor cover 14, an air intake baffle 16, a baffle 18 and an air intake cover 20. As shown in FIG. 4, the lower motor cover assembly 12 comprises a port lower motor cover part 22 and a starboard lower motor cover part 24 which are bolted together. Each lower motor cover part has a U-shaped recess 25 which meet to form an opening that allows the steering arm assembly to penetrate the lower motor cover and attach to the assembly (described below) which supports the powerhead. The upper motor cover is preferably made of acetyl butyl styrene, while the lower motor cover is preferably made of fiberglass.

Referring again to FIG. 1, the weight of the powerhead 8 is supported by an exhaust housing assembly 26, which is in turn mounted to the swivel bracket 4 in a known manner. In particular, the exhaust housing assembly comprises an adapter (not shown) on which the powerhead is seated, an outer exhaust housing 30 and an inner exhaust housing (not shown), all of which are preferably made of aluminum. Exhaust from the powerhead flows downward through a passageway in the inner exhaust housing. A gear case 32 is attached to the bottom of the exhaust housing assembly 26. The gear case houses the lowermost part of the vertical drive shaft (not shown) which is coupled to the powerhead, the propeller shaft (not shown) and the gears (not shown) for converting rotation of the drive shaft into rotation of the propeller shaft. A propeller 34 is mounted on the end of the propeller shaft in conventional manner. The exhaust gases flow through the inner exhaust housing and are exhausted below the waterline through an outlet in the propeller hub 36.

Figure 5:
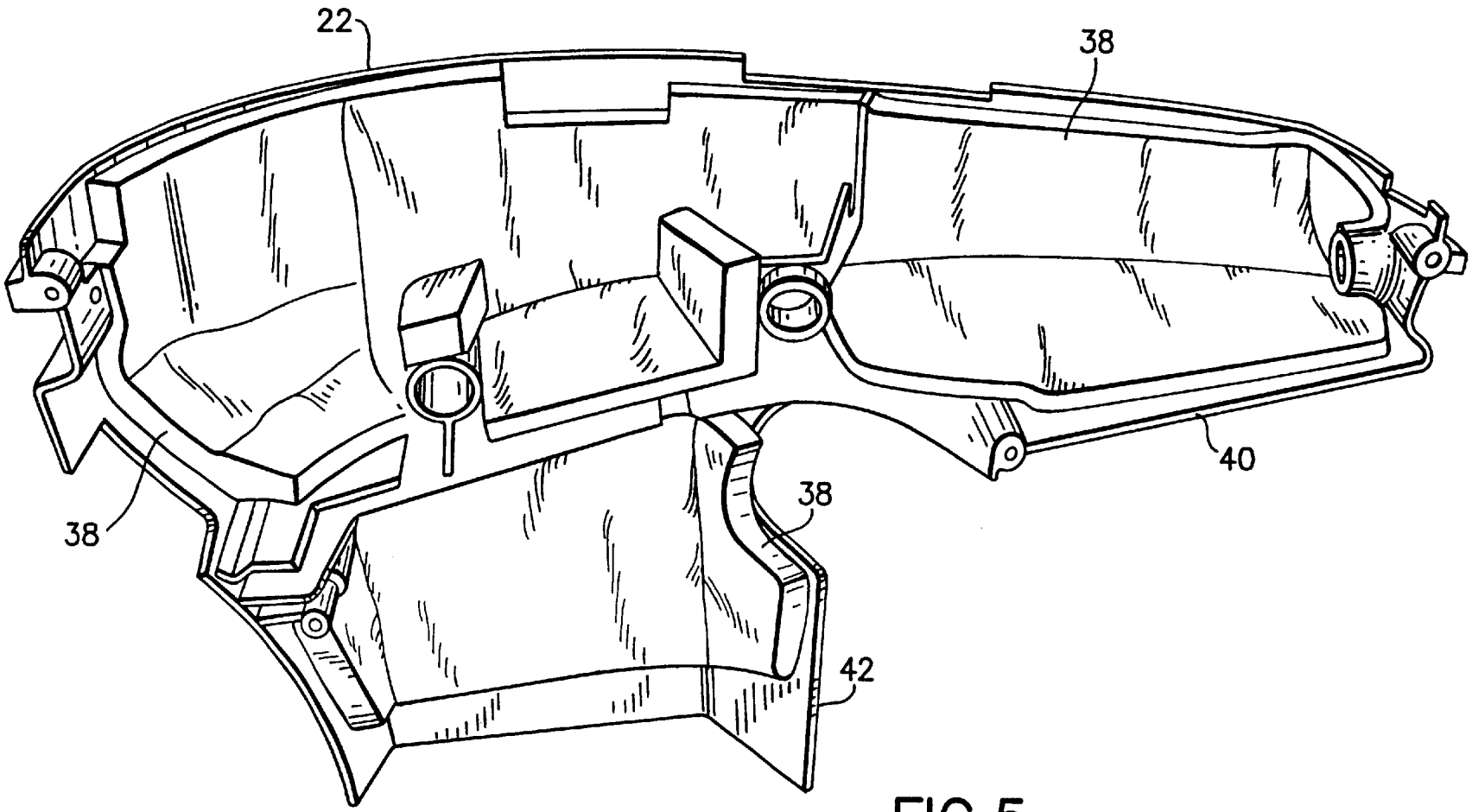
FIG. 5 is a schematic showing the port lower cover having a vibro-acoustic treatment in accordance with the preferred embodiment of the invention.

In accordance with the preferred embodiment of the invention, the inner surfaces of the port lower motor cover part 22 are blanketed with a vibro-acoustic treatment 38, as shown in FIG. 5, and the inner surfaces of the starboard lower motor cover part are blanketed with a similar vibro-acoustic treatment (not shown). In addition, the inner surfaces of the upper motor cover are also blanketed with a vibro-acoustic treatment. These vibro-acoustic treatments form a shroud that suppresses noise produced by the engine. As seen in FIG. 4, each of the port and starboard lower motor cover parts 22 and 24 comprises an upper portion 40 having inner surfaces which confront the powerhead and a lower portion 42 having inner surfaces which confront the uppermost portion of the exhaust housing assembly 26. In accordance with the preferred embodiment, the inner surfaces of both the upper and lower portions of the port and starboard lower motor cover parts are treated with a composite material that damps mechanical vibrations and blocks/absorbs acoustic wave energy.

Figure 6:
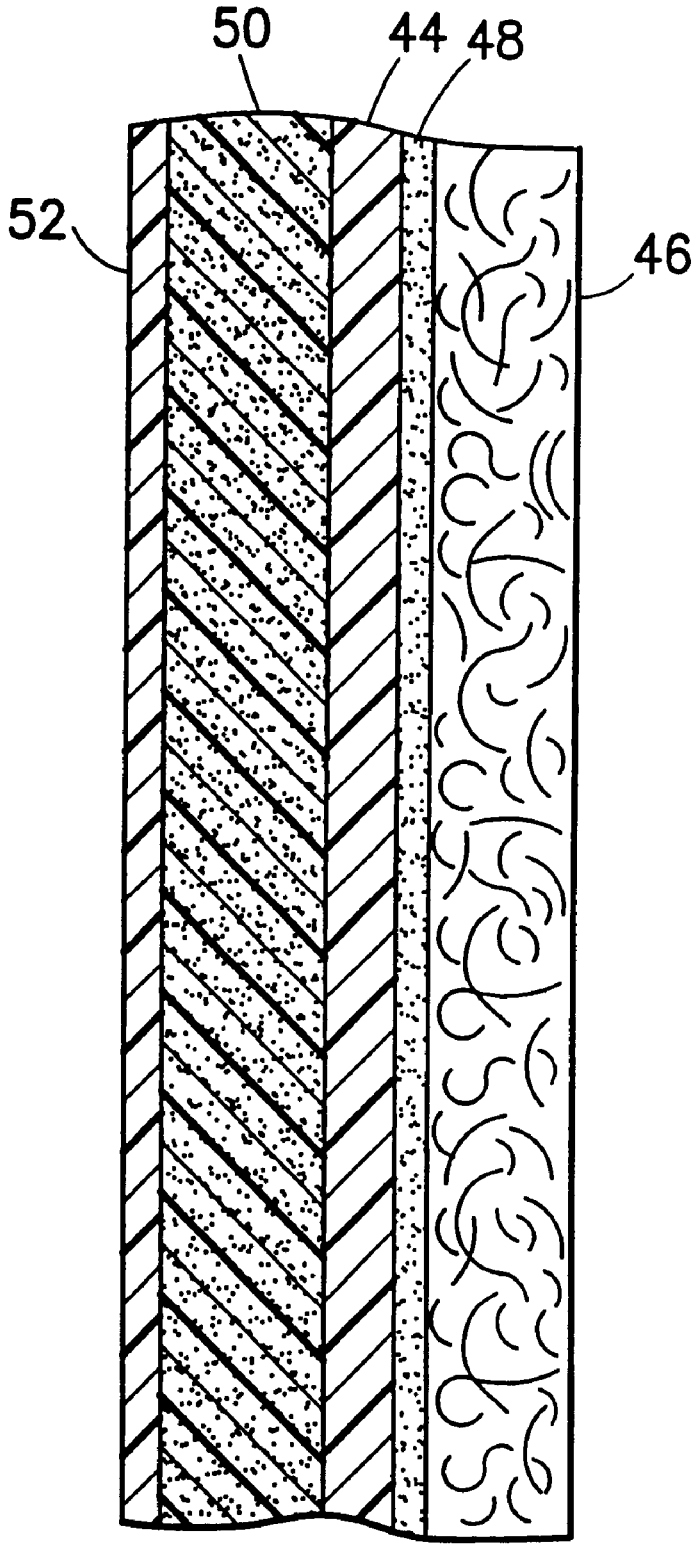
FIG. 6 is a schematic showing the composite material used in the vibro-acoustic treatment in accordance with the preferred embodiment of the invention.

The structure of the vibro-acoustic composite material in accordance with the preferred embodiment of the invention is depicted in FIG. 6. The composite material comprises a sheet of moldable acoustic barrier-like material 44 adhered to an inner surface of a motor cover or motor cover part 46 by means of a layer of visco-elastic pressure-sensitive adhesive material 48. [It should be understood that item 46 in FIG. 6 represents a portion of either the upper or the lower motor cover, and that both covers receive the vibro-acoustic treatment in accordance with the preferred embodiment.] Preferably the acoustic barrier material is free of plasticizers, which tend to migrate into the adhesive layer, causing softening and a decrease in peel strength. The composite material further comprises an acoustical grade, open-cell flexible foam core 50 laminated to the sheet of acoustic barrier material 44. Optionally, a film facing 52 is fused to the open-cell foam core 50. The preferred materials for the acoustic barrier and the adhesive are ethylene vinyl acetate and co-polymer acrylic adhesive, respectively. The preferred material for both the open-cell foam core 50 and the film facing 52 was polyether-based polyurethane. However, as explained in more detail below, functionally equivalent materials can be used in place of the specific materials disclosed herein.

In the case of a known 250-hp engine treated with vibro-acoustic composite material on both the upper and lower motor covers, the respective vibro-acoustic treatments were different. In the case of the lower motor cover, the sheet of ethylene vinyl acetate had a density of 2 lb./ft$^2$; the acrylic adhesive layer 48 had a thickness of 4 mils; the open-cell polyurethane foam core had a thickness of 0.5 inch; and the film facing had a thickness of 0.005 inch. In the case of the upper motor cover, the sheet of ethylene vinyl acetate had a density of 1 lb./ft$^2$; the acrylic adhesive layer 48 had a thickness of 4 mils; the open-cell polyurethane foam core had a thickness of 0.25 inch; and the film facing had a thickness of 0.005 inch.

The acoustic barrier adhered to the lower motor cover is designed to block transmission of a substantial portion of impinging acoustic wave energy in a range from 0 to 3,000 hertz, whereas the acoustic barrier adhered to the upper motor cover is designed to block transmission of a substantial portion of impinging acoustic wave energy in a range from 1,000 to 3,000 hertz. Preferably, the acoustic barrier material applied to the lower motor cover has a mass per unit area such that a transmission loss of at least 6 dB is attained for transmission of acoustic wave energy over the range from 0 to 3,000 hertz, whereas the acoustic barrier material applied to the upper motor cover has a mass per unit area such that a transmission loss of at least 6 dB is attained for transmission of acoustic wave energy over the range from 1,000 to 3,000 hertz. More specifically, the acoustic barrier for the lower motor cover preferably has a greater mass per unit area than that of the upper motor cover material for blocking the lowest frequencies, i.e., less than 1,000 hertz. Acoustic barrier materials are well known and commercially available.

In accordance with a further aspect of the preferred embodiment, the layers of adhesive material on the inner surfaces of the upper and lower motor covers each have a thickness such that impinging acoustic wave energy in a range of 1,000 to 3,000 hertz is efficiently converted into heat energy. In particular, each layer of adhesive material should have a thickness such that impinging acoustic wave energy is converted into heat energy to achieve an overall reduction of at least 3 dBa for the ⅓ octave band levels in a range from 0 to 4,000 hertz.

In addition, each vibro-acoustic treatment comprises an open-cell foam core laminated to the side of the acoustic barrier material opposite the adhesive. This open-cell foam core should have an average pore size that is optimized to attenuate, i.e., absorb, acoustic wave energy in a range of 1,000 to 3,000 hertz.

In accordance with the preferred embodiment of the present invention, a powerhead of an outboard marine engine is shrouded to damp vibrations and suppress noise. Preferably the vibro-acoustic treatment disclosed herein is used in combination with an acoustic seal placed across a portion of the opening in the lower motor cover which is penetrated by the steering arm assembly. This acoustic seal across the opening for the steering arm serves to reduce the amount of acoustic wave energy leaking out through the opening.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "acoustic barrier material" does not include open-cell foam.

What is claimed is:

1. A propulsion system comprising:

a motor;

a housing encasing said motor and having an inner surface, said housing comprising an upper part and a lower part;

a first vibro-acoustic treatment covering at least a portion of said inner surface of said upper part of said housing, said first vibro-acoustic treatment being designed to shift acoustic energy in the frequencies between 1000 and 3000 hertz to frequencies below 1000 hertz and above 3000 hertz; and a second vibro-acoustic treatment covering at least a portion of said inner surface of said lower part of said housing, said second vibro-acoustic treatment being optimized to attenuate acoustic energy in the frequencies below 1000 hertz, wherein each of said vibro-acoustic treatments comprises a sheet of acoustic barrier material and a layer of adhesive material for adhering said sheet of acoustic barrier material to said inner surface of a respective one of said upper and lower parts of said housing.

2. The propulsion system as recited in claim 1, wherein said sheet of acoustic barrier material has a mass per unit area such that a transmission loss of at least 6 dB is attained for transmission of acoustic wave energy in a range of 1,000 to 3,000 hertz.

3. The propulsion system as recited in claim 1, wherein said layer of adhesive material has a thickness such that impinging acoustic wave energy in a range of 1,000 to 3,000 hertz is efficiently converted into heat energy.

4. The propulsion system as recited in claim 3, wherein said layer of adhesive material has a thickness such that impinging acoustic wave energy is converted into heat energy to achieve an overall reduction of at least 3 dBa for the 1/3 octave band levels in a range from 0 to 4,000 hertz.

5. The propulsion system as recited in claim 1, wherein said vibro-acoustic treatment further comprises an open-cell foam core laminated to said sheet of acoustic barrier material.

6. The propulsion system as recited in claim 5, wherein said open-cell foam core has an average pore size which has been optimized to absorb acoustic wave energy in a range of 1,000 to 3,000 hertz.

7. The propulsion system as recited in claim 1, wherein said layer of adhesive material has a thickness of at least 4 mils.

8. The propulsion system as recited in claim 1, wherein said first vibro-acoustic treatment is not designed to attenuate frequencies below 1000 hertz.

9. A propulsion system comprising:

a motor;

a housing encasing said motor and comprising an upper motor cover and a lower motor cover, each of said upper and lower motor covers having an inner surface;

a first vibro-acoustic treatment covering at least a portion of said inner surface of said lower motor cover and being designed to shift acoustic energy in the frequencies between 1000 and 3000 hertz to frequencies below 1000 hertz and above 3000 hertz, wherein said first vibro-acoustic treatment comprises a first sheet of acoustic barrier material and a first layer of adhesive material for adhering said first sheet of acoustic barrier material to said inner surface of said lower motor cover; and a second vibro-acoustic treatment covering at least a portion of said inner surface of said upper motor cover and being optimized to attenuate acoustic energy in the frequencies below 1000 hertz, wherein said second vibro-acoustic treatment comprises a second sheet of acoustic barrier material and a second layer of adhesive material for adhering said second sheet of acoustic barrier material to said inner surface of said upper motor cover.

10. The propulsion system as recited in claim 9, wherein said first sheet of acoustic barrier material is designed to block transmission therethrough of a substantial portion of impinging acoustic wave energy in a range from 0 to 3,000 hertz, and said second sheet of acoustic barrier material is designed to block transmission therethrough of a substantial portion of impinging acoustic wave energy in a range from 1,000 to 3,000 hertz.

11. The propulsion system as recited in claim 9, wherein said first sheet of acoustic barrier material has a mass per unit area which is greater than a mass per unit area of said second sheet of acoustic barrier material.

12. The propulsion system as recited in claim 9, wherein each of said first and second layers of adhesive material has a thickness such that impinging acoustic wave energy in a range of 1,000 to 3,000 hertz is efficiently converted into heat energy.

13. The propulsion system as recited in claim 12, wherein each of said first and second layers of adhesive material has a thickness such that impinging acoustic wave energy is converted into heat energy to achieve an overall reduction of at least 3 dBa for the 1/3 octave band levels in a range from 0 to 4,000 hertz.

14. The propulsion system as recited in claim 9, wherein said first vibro-acoustic treatment further comprises a first open-cell foam core laminated to said first sheet of acoustic barrier material, and said second vibro-acoustic treatment further comprises a second open-cell foam core laminated to said second sheet of acoustic barrier material.

15. The propulsion system as recited in claim 14, wherein said first open-cell foam core has a thickness greater than a thickness of said second open-cell foam core.

16. The propulsion system as recited in claim 14, wherein each of said first and second open-cell foam cores has an average pore size which has been optimized to absorb acoustic wave energy in a range of 1,000 to 3,000 hertz.

17. The propulsion system as recited in claim 9, wherein each of said first and second layers of adhesive material has a thickness of at least 4 mils.

18. A housing for an outboard marine engine, comprising an upper cover and a lower cover, said upper cover being attached to said lower cover, said attached upper and lower covers surrounding the outboard marine engine, each of said upper and lower covers having an inner surface, further comprising a first vibro-acoustic treatment covering at least a portion of said inner surface of said upper cover and being designed to shift acoustic energy in the frequencies between 1000 and 3000 hertz to frequencies below 1000 hertz and above 3000 hertz, wherein said first vibro-acoustic treatment comprises a first sheet of acoustic barrier material and a first layer of adhesive material for adhering said first sheet of acoustic barrier material to said inner surface of said upper cover, and a second vibro-acoustic treatment covering at least a portion of said inner surface of said lower cover and being optimized to attenuate acoustic energy in the frequencies below 1000 hertz, wherein said second vibro-acoustic treatment comprises a second sheet of acoustic barrier material and a second layer of adhesive material for adhering said second sheet of acoustic barrier material to said inner surface of said lower cover.

19. The housing as recited in claim 18, wherein said second sheet of acoustic barrier material is designed to block transmission therethrough of a substantial portion of impinging acoustic wave energy in a range from 0 to 3,000 hertz, and said first sheet of acoustic barrier material is designed to block transmission therethrough of a substantial portion of impinging acoustic wave energy in a range from 1,000 to 3,000 hertz.

20. The housing as recited in claim 18, wherein said first sheet of acoustic barrier material has a mass per unit area which is less than a mass per unit area of said second sheet of acoustic barrier material.

21. The housing as recited in claim 18, wherein said first layer of adhesive material has a thickness of at least 4 mils.

22. The housing as recited in claim 18, wherein said first vibro-acoustic treatment further comprises a first open-cell foam core laminated to said first sheet of acoustic barrier material.

23. The housing as recited in claim 18, wherein said first vibro-acoustic treatment further comprises a first open-cell foam core laminated to said first sheet of acoustic barrier material, and said second vibro-acoustic treatment further comprises a second open-cell foam core laminated to said second sheet of acoustic barrier material.

24. A method for suppressing noise from a powerhead mounted inside a housing of a propulsion system, comprising the steps of covering at least a portion of an inner surface of an upper portion of the housing with a first vibro-acoustic treatment, and covering at least a portion of an inner surface of a lower portion of the housing with a second vibro-acoustic treatment, wherein each of said vibro-acoustic treatments comprises a respective sheet of acoustic barrier material and a respective layer of adhesive material for adhering said respective sheet of acoustic barrier material to the inner surface of the housing, said first vibro-acoustic treatment is designed to shift acoustic energy in the frequencies between 1000 and 3000 hertz to frequencies below 1000 hertz and above 3000 hertz, and said second vibro-acoustic treatment is optimized to attenuate acoustic energy in the frequencies below 1000 hertz.

25. The method as recited in claim 24, wherein said sheet of acoustic barrier material has a mass per unit area such that a transmission loss of at least 6 dB is attained for transmission of acoustic wave energy in a range of 1,000 to 3,000 hertz.

26. The method as recited in claim 24, wherein said layer of adhesive material has a thickness such that impinging acoustic wave energy in a range of 1,000 to 3,000 hertz is efficiently converted into heat energy.

27. The method as recited in claim 26, wherein said layer of adhesive material has a thickness such that impinging acoustic wave energy is converted into heat energy to achieve an overall reduction of at least 3 dBa for the 1/3 octave band levels in a range from 0 to 4,000 hertz.

28. The method as recited in claim 24, wherein said vibro-acoustic treatment further comprises an open-cell foam core laminated to said sheet of acoustic barrier material.

29. The method as recited in claim 28, wherein said open-cell foam core has an average pore size which has been optimized to absorb acoustic wave energy in a range of 1,000 to 3,000 hertz.

30. The method as recited in claim 24, wherein said layer of adhesive material has a thickness of at least 4 mils.

* * * * *